United States Patent [19]

Steiner et al.

[11] Patent Number: 5,005,252

[45] Date of Patent: Apr. 9, 1991

[54] PORTABLE WET/DRY VACUUM CLEANER AND RECHARGING BASE

[75] Inventors: Robert E. Steiner, Chesterfield, Mo.; Daniel S. Soultanian, Boyle County, Ky.

[73] Assignee: Emerson Electric Co., St. Louis, Mo.

[21] Appl. No.: 473,332

[22] Filed: Feb. 1, 1990

Related U.S. Application Data

[63] Continuation of Ser. No. 274,724, Nov. 9, 1988, Pat. No. 4,899,418, which is a continuation of Ser. No. 77,234, Jul. 24, 1987, abandoned.

[51] Int. Cl.[5] ..... A47L 9/28

[52] U.S. Cl. ..... 15/339; 15/344; 15/353; 15/DIG. 1

[58] Field of Search ..... 15/339, 344, 350, 353, 15/DIG. 1

[56] References Cited

U.S. PATENT DOCUMENTS

| | | | |
|---|---|---|---|
| Re. 33,074 | 10/1989 | Levine | 15/344 |
| 278,278 | 4/1885 | McCloskey | D32/18 |
| 2,306,212 | 12/1942 | Gerstmann | 183/21 |
| 2,639,005 | 5/1953 | Gerstmann | 183/75 |
| 3,213,481 | 10/1965 | Minerley | 15/32 |
| 3,513,500 | 5/1970 | Hori | 15/344 |
| 4,011,624 | 3/1977 | Proett | 15/344 |
| 4,105,420 | 8/1978 | Moore | 55/274 |
| 4,179,768 | 12/1979 | Sawyer | 15/352 |
| 4,209,875 | 7/1980 | Pugh et al. | 15/344 |
| 4,225,814 | 9/1980 | Gantz et al. | 15/DIG. 1 |
| 4,536,914 | 8/1985 | Levine | 15/344 |
| 4,542,557 | 9/1985 | Levine | 15/344 |
| 4,573,234 | 3/1986 | Kochte et al. | 15/344 X |
| 4,577,365 | 3/1986 | Yuen | 15/339 |
| 4,682,384 | 7/1987 | Prahl et al. | 15/344 |
| 4,798,613 | 1/1989 | Hetherington et al. | 15/353 X |
| 4,821,366 | 4/1989 | Levine | 15/344 |

FOREIGN PATENT DOCUMENTS

| | | | |
|---|---|---|---|
| 497495 | 4/1930 | Fed. Rep. of Germany . | |
| 742954 | 11/1944 | Fed. Rep. of Germany . | |
| 2153664 | 10/1972 | Fed. Rep. of Germany . | |
| 3325333 | 1/1985 | Fed. Rep. of Germany | 15/344 |
| 1094460 | 12/1953 | France . | |
| 1264362 | 8/1960 | France . | |
| 1493194 | 2/1966 | France . | |
| 2371909 | 11/1977 | France . | |

OTHER PUBLICATIONS

Consumer Reports, Oct. 1988, pp. 619-621.

*Primary Examiner*—Chris K. Moore
*Attorney, Agent, or Firm*—Polster, Polster and Lucchesi

[57] ABSTRACT

A portable wet/dry vacuum cleaner is disclosed having a handle base and a combination nozzle/debris container. The handle base comprises a housing having a motor, a blower driven by the motor, and a battery pack for energization of the motor located therein. The blower is in communication with the container for forceably drawing air and entrained debris in the air into the container, for depositing the debris in the container, and for exhausting air from the handle base. A channel is provided within the outer end of the container, which channel extends inwardly and upwardly, but terminates short of the housing. The latter has an air duct between the nozzle/debris container and the blower having an inlet spaced from the inner end of the channel. A deflector is disposed between the inner end of the channel and the inlet of the air duct for directing debris entrained into the air exhausted from the channel away from the air duct inlet. The vacuum cleaner (or appliance) further includes a charging base for holding or mounting the vacuum cleaner. The charging base has a recess formed therein to receive at least a portion of the handle base. The handle base has a receptacle formed therein and a finger from the recharging base fits into the receptacle such that the vacuum cleaner is rotated on the finger toward the recharging base, electrical charging terminal both on the vacuum cleaner and on the recharging base cammingly engage one another thereby to resiliently hold the vacuum cleaner in place on the base and to permit recharging of the batteries within the vacuum cleaner.

16 Claims, 3 Drawing Sheets

PORTABLE WET/DRY VACUUM CLEANER AND RECHARGING BASE

BACKGROUND OF THE INVENTION

This invention relates to a portable, cordless wet/dry vacuum cleaner and to a recharging base for the vacuum cleaner.

Generally, portable, cordless vacuum cleaners have, in recent years, come into widespread use for cleaning a variety of surfaces, such as localized areas of a kitchen floor, shelves, automobile interiors, small areas of carpet, or other hard-to-reach places. These cordless vacuum cleaners are portable and are relatively lightweight and small in size such that the user can readily utilize them in hard-to-reach places where a large canister, upright, or shop-type vacuum cleaner could not readily be utilized. Typically, these cordless portable vacuum cleaners are utilized for small clean-up jobs. Examples of such cordless, portable vacuum cleaners may be seen by referring to prior U.S. Pat. Nos. 4,011,624 and 4,209,875.

While such prior art portable cordless vacuum cleaners worked well for their intended purposes, they were, for the most part, only useful in picking up dry debris, such as dust or particulate matter. These prior cordless portable vacuum cleaners were not intended to clean up liquid spills. Certain of these prior art cordless vacuum cleaner designs utilized filters which could come into direct contact with a liquid sucked up by the vacuum cleaner, such that the filter pad would absorb and retain moisture. In other prior art portable vacuum cleaner designs, the motor would be exposed to any liquid picked up by the vacuum cleaner.

Such cordless portable vacuum cleaners typically use a rechargable battery pack carried within the vacuum cleaner housing. As is conventional, a battery charger is typically provided with the cordless vacuum cleaner which may be plugged into a conventional wall socket for drawing 110-volt AC current therefrom, for stepping the current down to an appropriate voltage level, and for converting the alternating current to direct current. In this regard, any number of conventional battery chargers well known in the art may be utilized, with the particular battery charger depending on the characteristics of the rechargable battery pack.

It has been recognized that it is generally desirable that the vacuum cleaner itself not have any cord extending therefrom for recharging purposes, inasmuch as the cord would have to be carried with the vacuum cleaner during conventional use. It has also been recognized that a combination battery recharging base and holder can be utilized for the dual purposes of storing the vacuum cleaner at a convenient horizontal or vertical position and, at the same time, simultaneously effecting the charging of the battery pack within the vacuum cleaner. These prior art cordless appliances (whether vacuum cleaners or otherwise) and recharging bases typically utilize the recharging electrical terminals for the dual purpose of recharging and positively holding the vacuum cleaner or other appliance in place on the recharging base Reference may be made to prior U.S. Pat. No. 4,225,814, showing a cordless vacuum cleaner storing and recharging system. While this system worked well for its intended purposes, it required two spaced-apart male terminals which extended outwardly from the recharging base such that a receptacle on the cordless vacuum cleaner must be brought into register with these spaced terminals. In addition, the base was required to be somewhat longer than the entire length of the vacuum cleaner because a pocket was formed in the end of the recharging base which received the forward or nozzle end of the vacuum cleaner. A resilient spring was provided at the opposite end of the vacuum cleaner for retaining the vacuum cleaner on the base with its nose or forward end received by the pocket in the base and with a receptacle on the vacuum cleaner receiving the spaced-apart terminals. It will thus be noted that in order to install the vacuum cleaner in its base, in the manner shown in the above-mentioned U.S. Pat. No. 4,225,814, it is first necessary to insert the nose of the vacuum cleaner into the pocket, to align the two terminals with the receptacle, and then to engage the handle with the spring retainer. In other words, installing the vacuum cleaner on the recharging base is a three-step procedure. It will also be noted that the electrical recharging terminals project upwardly from the surface of the recharging base and are thus susceptible to damage.

SUMMARY OF THE INVENTION

Among the several objects and features of the present invention may be noted the provision of a portable vacuum cleaner which may be utilized to pick up both dry debris and liquids;

The provision of such a portable vacuum cleaner which, inside the debris container, deflects entrained debris and liquid droplets downwardly and away from the air filter protecting the blower motor thereby to prevent undue clogging or wetting of the air filter;

The provision of such a portable vacuum cleaner which has a reservoir of ample size for retaining debris and liquid while maintaining the debris clear of the air inlet and filter;

The provision of such a portable vacuum cleaner in which debris and liquid may be readily emptied from the debris container without the necessity of removing the debris container from the handle/motor assembly;

The provision of such a portable vacuum cleaner which, by the ready addition of a squeegee to the air/debris inlet nozzle, enhances the ability of the vacuum cleaner to cleanly remove liquid from a relatively smooth surface, and for efficiently entraining the liquid in the air drawn into the vacuum cleaner and collecting the liquid within the debris container of the vacuum cleaner;

The provision of such a portable vacuum cleaner which requires no disassembly, assembly, or special tools for the insertion and removal of the squeegee;

The provision of such a vacuum cleaner in which the debris (whether particulate or liquid) together with the moving air is deflected away from an air duct inlet within the vacuum cleaner and is caused to swirl within the debris container thereby substantially reducing the velocity of the entrained debris and liquid and allowing the debris and liquid to drop out of entrainment with the air while permitting air to be freely drawn into the air inlet for creating a partial vacuum within the debris container;

The provision of such a portable vacuum cleaner in which the ability of the vacuum cleaner to vacuum collect liquids is enhanced;

The provision of such a portable vacuum cleaner in which air from the blower is discharged in a uniform and controlled manner through vent openings in the side of the handle base in such manner as to not disturb debris being cleaned up with the vacuum cleaner;

The provision of a recharging holder for a battery-operated appliance, such as a cordless vacuum cleaner, having a pair of substantially flush resilient electrical contacts which resiliently engage a mating pair of substantially flush electrical contacts on the appliance upon installation of the appliance on the mounting base for the dual purpose of initiating charging of the battery pack of the appliance, and for resiliently holding the appliance on the mounting and charging base;

The provision of such a mounting and charging base which has the provision of storing accessories, such as a water pick-up squeegee or the like, within the mounting base; and The provision of such a portable vacuum cleaner and recharging base which is of rugged and economical construction, which remains fully charged when stored, even for long periods of time, which is reliable in operation, which has a relatively long duty cycle, and which effectively picks up both wet and dry debris.

Other objects and features of this invention will be in part apparent and in part pointed out hereinafter.

Briefly stated, a portable vacuum cleaner of the present invention comprises a handle base assembly and a nozzle/debris container removably secured to the handle base assembly. The handle base assembly comprises a housing having a handle permitting a user to lift and control the vacuum cleaner. This housing has a motor located therewithin and a blower driven by the motor. The blower is in communication with the container for forceably drawing air and debris entrained in the air into the container for depositing the debris within the container and for exhausting air from the housing. A channel is provided within the outer end of the container. The outer end of this channel constitutes the air/debris inlet for the vacuum cleaner, and the channel extends from the air/debris inlet toward the housing, but terminates short of the housing, and is in communication with the container. The latter has an air duct between the container and the blower, with the air duct having an inlet spaced from the inner end of the channel. A deflector is provided between the inner end of the channel and the inlet of the duct for directing debris entrained in the air exhausted from the channel away from the air duct inlet.

In another embodiment of this invention, a recharging base is provided for recharging the rechargable battery pack contained within a cordless vacuum or other appliance. The appliance has a pair of electrical terminals carried by the housing, with these housing terminals being electrically connected to the battery pack for charging thereof. The housing further has a notch therein. The recharging base has a frame adapted to receive at least a portion of the housing, and further has a pair of base terminals secured to the frame and being resiliently engageable with the housing terminals for making an electrical connection therebetween when the appliance is fully installed within the recharging base. The housing terminals and the base terminals are resiliently deformable relative to one another as the appliance is moved fully into or out of engagement with the recharging base. The housing further has a receptacle therein and the base has a finger insertable into the receptacle. The base terminals and the finger on the base are spaced apart a predetermined distance, and the housing terminals and the notch on the housing of the appliance are spaced apart a distance slightly greater than the above-noted spaced-apart distance of the base terminals and the finger such that upon placing the notch on the finger and upon moving the housing terminals and the base terminals toward one another, the base and housing terminals cause relative resilient deformation of one another so as to effect both electrical contact between the base and housing terminals and so as to releasably hold the appliance on the base.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
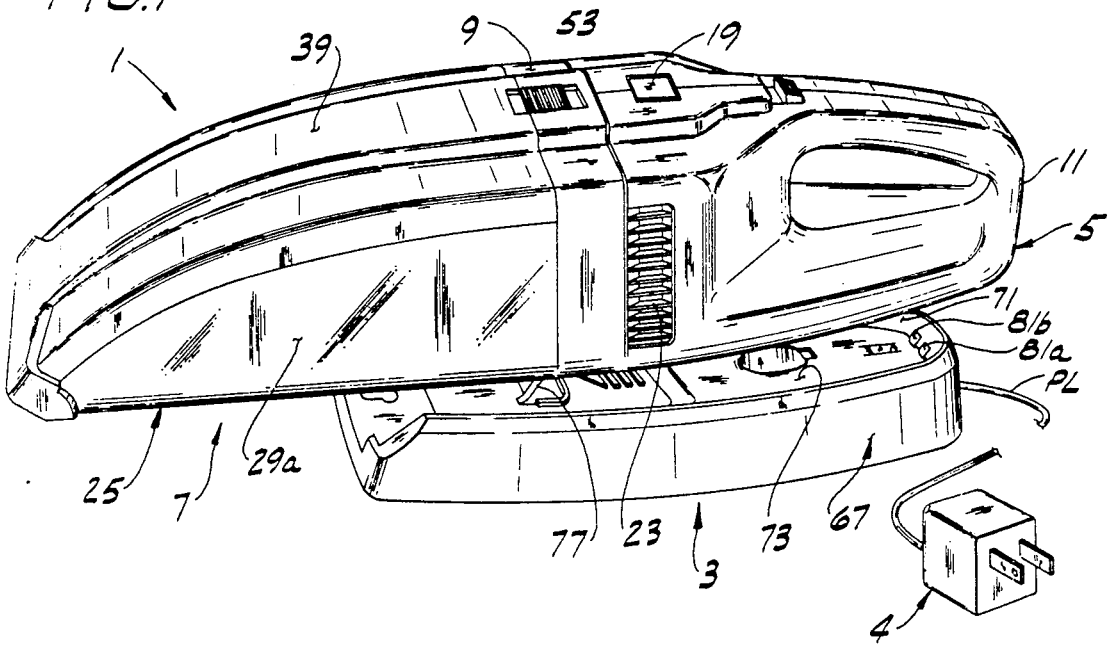
FIG. 1 is a perspective view of a portable cordless appliance, such as a hand-held vacuum cleaner of the present invention, as it is being removed from a combination storage and recharging base.

Referring now to the drawings, a portable cordless wet/dry vacuum cleaner (also referred to as an appliance) is indicated in its entirety by reference character 1. The appliance 1 includes a recharging base and holder, as generally indicated at 3. An AC/DC recharging adapter 4 is connected to the recharging base by a power lead PL in a manner as will appear for recharging a rechargable battery within the appliance As recognized by those skilled in the art, the AC/DC recharging adapter has a pair of male terminals which may be plugged into a conventional 110–120 volt wall outlet.

More specifically, vacuum cleaner 1 comprises a handle assembly, as generally indicated at 5. A nozzle/debris container 7 is secured to a base housing 9 which in turn is secured to handle assembly 5. The handle assembly comprises a handle housing 11 which is preferably of hollow construction and is molded of a suitable synthetic resin material. Housing 11 has an appropriate DC electric motor 13 mounted therein. Motor 13 is energized by means of a battery pack 15 comprising a plurality of suitable rechargable batteries. Those skilled in the art will recognize that a variety of different types of rechargable batteries may be utilized to constitute battery pack 15 and the batteries, per se, do not constitute a part of this invention. A centrifugal blower 17 is mounted on the rotor shaft (not shown) of motor 13 such that the blower is direct-driven by the motor. Energization of motor 13 is controlled by an on/off switch 19 conveniently located on the upper surface of the handle housing 11 for operation by the user's thumb when the user grasps the handle housing in the manner shown in FIG. 1.

Figures 8, 9, 10, 11, 13:
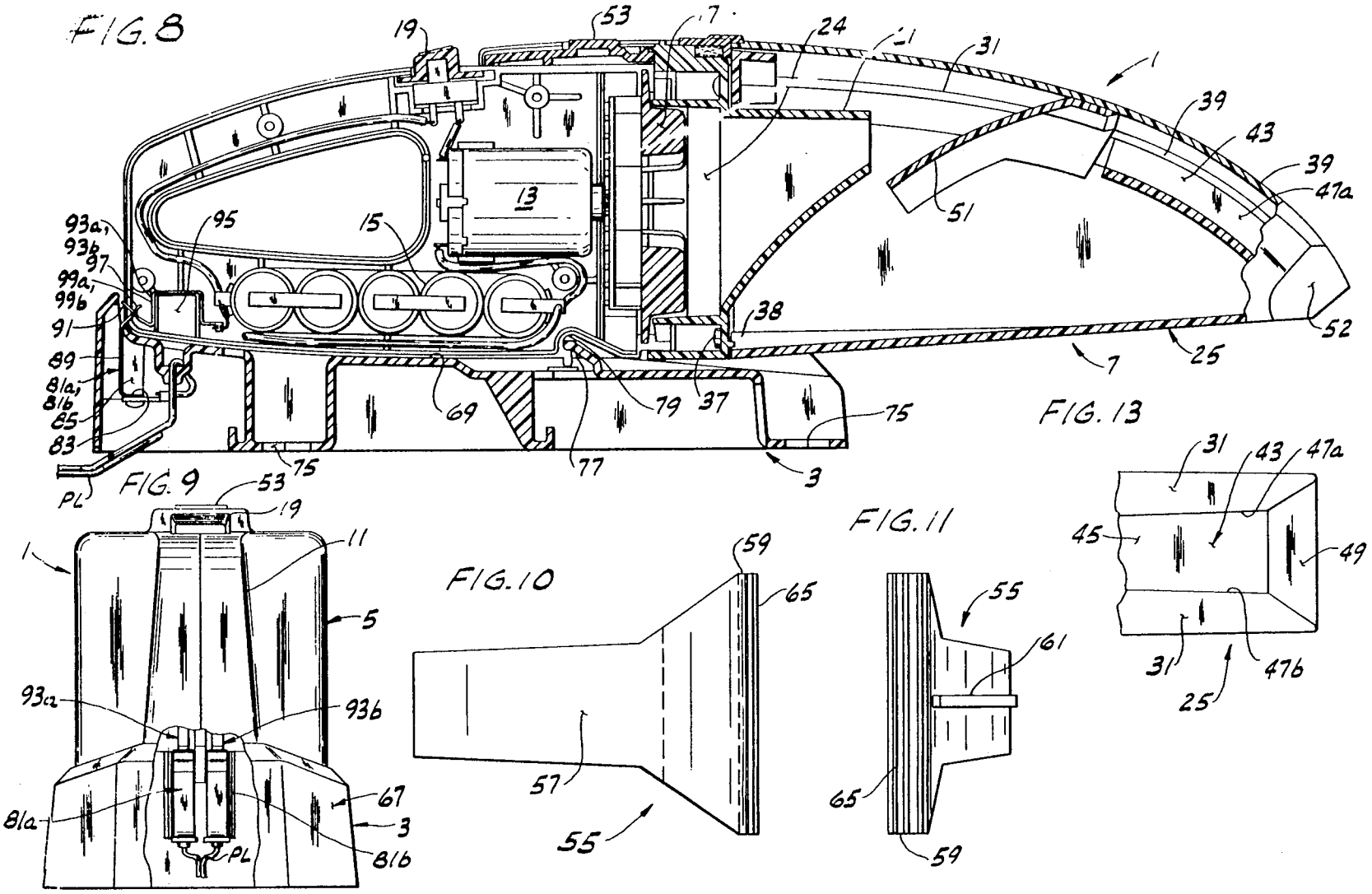
FIG. 8 is a longitudinal cross sectional view of both the vacuum cleaner and the recharging base on an enlarged scale relative to FIGS. 2–4, illustrating details of construction of both the vacuum cleaner and the recharging base.
FIG. 9 is a rear elevational view of FIG. 8, illustrating cam actuated combination electrical and retaining terminals carried both by the vacuum cleaner and the base.
FIG. 10 is a top plan view of a squeegee which may be inserted into the air/debris inlet nozzle of the vacuum cleaner for scraping liquid from a surface, and for directing the collected liquid into the vacuum cleaner for being effectively entrained with the air drawn into the vacuum cleaner for collection purposes.
FIG. 11 is a front elevational view of FIG. 11.
FIG. 13 is a top plan view of the forward or outer end of the debris container, with a cover removed, illustrating an air/debris channel leading into the debris container.

As shown in FIG. 9, an air inlet duct 21 is located on the outer or forward end of base housing 9 and provides a flow path between the interior of nozzle/debris container 7 and blower 17 such that the blower may draw air from within the nozzle/debris container and exhaust the air from the handle housing 11 by means of a number of air outlet openings 23 (see FIGS. 1 and 2) provided in one side of base housing 9. A foam filter pad 24 is interposed between air inlet duct 21 and blower 17 so as to prevent dust and other airborne debris from being drawn into the blower during operation of the latter.

Nozzle/debris container 7 comprises a container shell 25 preferably molded of a suitable synthetic resin material. Even more preferably, container shell 25 is molded of a suitable transparent plastic resin so that the user may readily visually observe the amount of debris collected by the vacuum cleaner within container 7. The container shell has a shell bottom 27 with integral upwardly extending shell sides 29*a*, 29*b*. As seen in FIG. 9, the top 31 of container shell 25 slopes downwardly in a curvilinear fashion and has an opening 33 (see FIG. 2) therein so as to permit the emptying of debris from within container 7. As shown in FIG. 9, integrally molded vanes 35 are provided on base housing 9 downstream from filter 24 so as to direct the flow in generally axial direction from air duct 21 to the blower 17 driven by motor 13 and to retain foam filter pad 24 away from blower. A plurality of fastening screws 37 threadably engage screw bosses 38 provided in container shell 25 for positively securing container shell 25 to base housing 9. A container cover 39 conforms generally to the shell top 31 so as to close off opening 33 in the shell top. Cover gaskets 41 are carried by container cover 39 so as to substantially positively seal the container cover 39 relative to shell top 31.

As indicated generally at 43, a channel is provided in shell top 31 at the front thereof (see FIG. 9). Channel 43 is defined by a channel base wall 45 and by channel side walls 47*a*, 47*b* extending generally vertically from the channel base 45. It will be appreciated that the channel base 45 and channel side walls 47*a*, 47*b* are integrally molded with the container shell 25 such that the resulting channel 43 formed generally in shell top 31 is a channel open at its top. As shown in FIG. 15, the channel side walls 47*a*, 47*b* angle outwardly at the forward end of container shell such that the channel inlet 49 is generally triangular shaped and extends substantially the full width of container shell 25.

Container cover 39 carries a deflector 51 which is disposed within container 25 between the inner end of channel 43 and the inlet end of air inlet duct 21 such that air and entrained in the air, moving at relatively high velocity through channel 43, is deflected downwardly into container shell 25 in a rotating or swirling fashion. This rotating or swirling motion imparted to the air by deflector 51 markedly decreases the velocity of the air and the debris entrained therein such that debris, even relatively light as dust or small particulate material, will settle and collect within container shell 25. At the same time, air from within the container shell 25 is drawn into the inlet end of air inlet duct 21 by blower 17, and the blower generates a sufficient partial vacuum within the container shell such that air is drawn into the container shell by means of channel inlet 49 at relatively high velocity thereby to pick up and entrain debris on a surface to be cleaned.

As heretofore noted, container cover 39 is removably mounted on shell top 31 and is sealed relative to the shell top by means of cover gaskets 41 which seal around opening 33 in the shell top, and which also seal channel 43 relative to the removable container cover 39. The container cover has a pair of cover lugs 52 at its outer or forward end which engage recesses (not shown) in the shell sides 29*a*, 29*b*, thus positively holding the container cover 39 in place relative to container shell 25 at the inlet end thereof. The cover may be rotated downwardly relative to shell top 31 such that the cover overlies and generally fits flush with shell top 31. A releasable cover latch 53 is carried by the upper portion of base housing 9 such that when the cover latch is engaged with the cover, the rear end of the cover is securely held in place relative to container shell 25 and such that the container cover forms the top portion of channel 43.

As heretofore noted, the vacuum cleaner 1 of the present invention is intended for picking up both wet and dry debris. By wet debris, it is intended that the vacuum cleaner 1 of the present invention is not only capable of picking up wet, solid material, such as dust, wet mud particles, or wet sawdust, but it is also intended that the vacuum cleaner 1 of the present invention is effective in cleaning a standing liquid, such as water, from a surface, such as from a floor or countertop. As will be hereinafter explained, the particular construction of vacuum cleaner 1 enables it to pick up standing liquid, to effectively air convey the liquid into nozzle/debris container 7, and to collect a substantial volume of the liquid (up to about 8 fluid ounces) within container 7. Of course, the liquid (or any other debris) may be readily emptied from the debris container 7 by removing cover 39 and dumping the liquid or debris from opening 33 in shell top 31.

In accordance with this invention, to enhance the liquid pick-up capabilities of vacuum cleaner 1 of the present invention, a flexible elastomeric squeegee, as generally indicated at 55, is inserted into the triangular-shaped channel inlet 49 and into channel 43 for aiding in physically scraping the liquid from a hard, non-porous surface, such as a floor or the like, for directing the liquid into the nozzle inlet, and for increasing the velocity of the air in the nozzle inlet and in channel 43 leading into container 7 for enhancing air closely fit within channel 43. The squeegee has a head 59 which is somewhat larger than the triangular channel inlet 49 to channel 43, such that the head extends outwardly and downwardly from the outer or inlet end of nozzle/debris container 7, as shown in FIG. 14. On the lower side of squeegee body 57, a body spacer rib 61 is provided engageable with the upper surface of channel base 45 thereby to ensure that squeegee body 57 is spaced above the channel base a predetermined distance, as determined by the thickness of spacer rib 61. It will be appreciated that the remaining air channel or gap 63 between the lower face of the squeegee and the upper face of channel base 45 is of markedly smaller cross section than the cross section of channel 43 without squeegee 55 inserted therein. This results in a substantial increase of velocity of the air moving through the remaining channel 63 as the air and any liquid debris entrained therein is drawn into container 7 by the partial vacuum generated therewithin by blower 17. This increased air velocity with the squeegee in place enhances the ability of the vacuum cleaner 1 of the present invention to pick up liquid and to effectively and efficiently air convey the liquid into container 7.

As shown best in FIGS. 11–14, squeegee head 59 is provided with a series of spaced squeegee wipers 65 extending across the width of the squeegee head such that when the squeegee is brought into scraping engagement with a surface to be cleaned and is moved in a rearward direction, a liquid standing on the surface to be cleaned is scraped along with the squeegee wiper and is directed toward the back of the squeegee where it may be readily picked up by air being drawn into debris container 7 such that the air with liquid droplets entrained therein moves readily through gap 63 between the outer surface of channel base 45 and the inner surface of squeegee head 59.

As shown test in FIGS. 8 and 9, recharging and holder base 3 preferably comprises a one-piece frame 67, injection molded of a suitable synthetic resin material. Frame 67 is substantially shorter than vacuum cleaner 1 and has a recess 69 provided therein for comfortably receiving the lower, rear portion of vacuum cleaner housing 9, in the manner illustrated in FIG. 9, with substantially the entire length of debris container 7 extending out beyond frame 67. Frame 67 has an inner wall 71 which, as shown in FIG. 8, defines the inner margins of recess 69. The bottom of the recess 69 is defined by a base wall 73, having two screw mounting holes 75 therein such that the frame 67 may be fixedly mounted in a vertical position to a wall, on in a horizontal position on a shelf or the like. As indicated at 76, an opening is provided in the front portion of frame 67 for receiving the base portion 57 of squeegee 55 such that the squeegee may be readily stored within base 3.

Base wall 73 of base 3 has a finger 77 extending upwardly and rearwardly therefrom (as best shown in FIG. 9) toward the closed end of recess 69 of the base frame. A corresponding notch 79 is provided in vacuum cleaner housing 9 for receiving and engaging finger 77.

Figure 2:
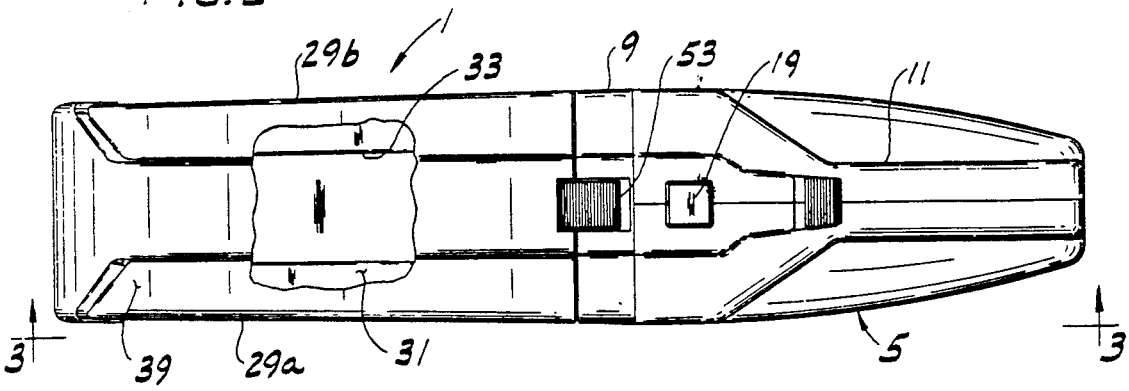
FIG. 2 is a top plan view of the portable cordless vacuum cleaner, with a portion of its debris container being broken away to show details of construction therewithin.
Figure 3:
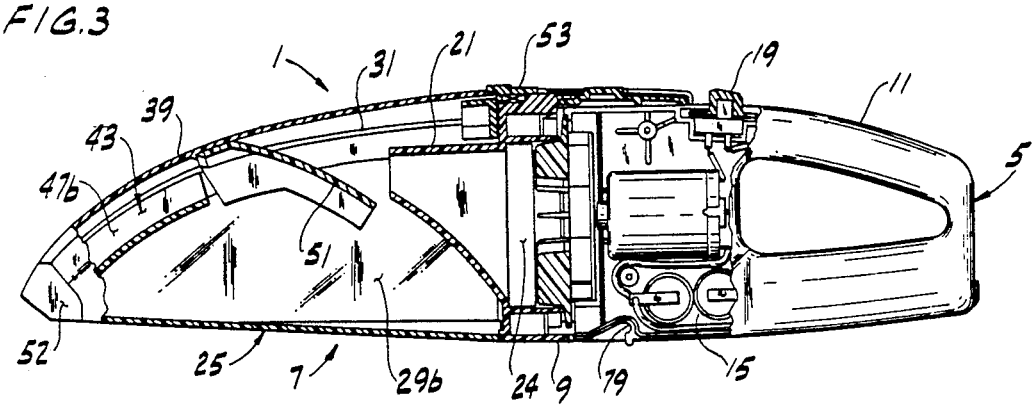
FIG. 3 is a side elevational view of FIG. 2, taken along line 3—3 of FIG. 2.
Figure 4:
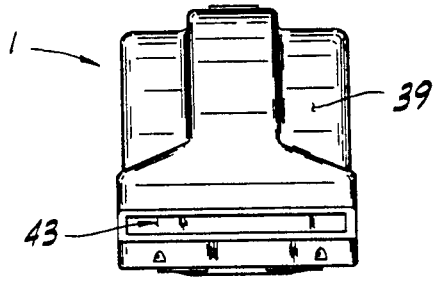
FIG. 4 is a front elevational view.
Figure 5:
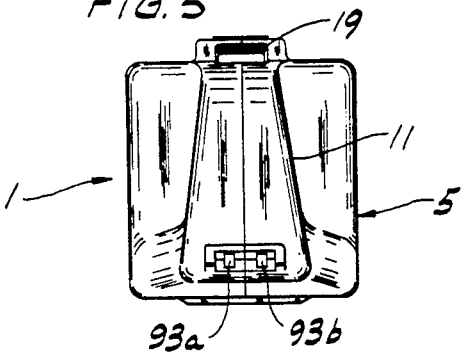
FIG. 5 is a rear elevational view.
Figure 6:
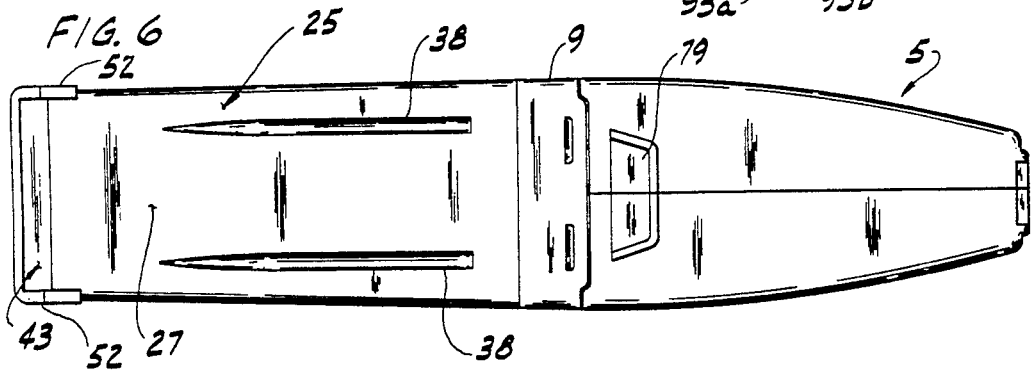
FIG. 6 is a bottom plan view of the portable cordless vacuum cleaner.
Figure 7:
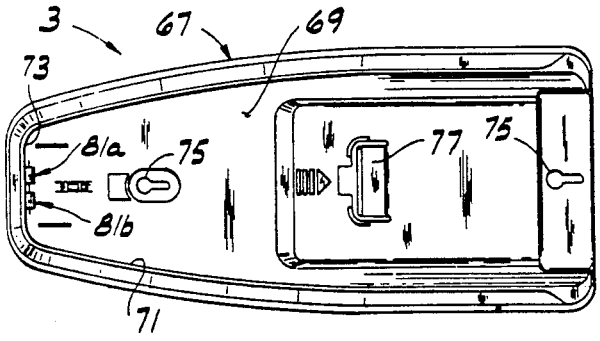
FIG. 7 is a top plan view of the above-noted combination holding and recharging base.
Figure 12:
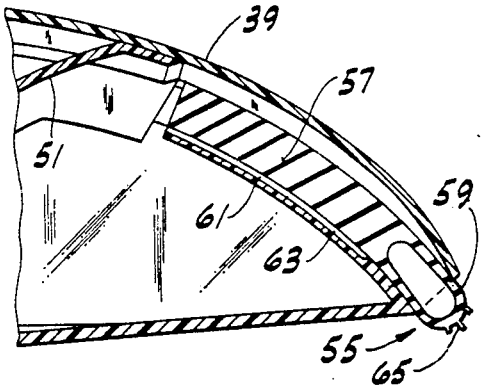
FIG. 12 is an enlarged scale partial cross sectional view of the righthand portion of the vacuum cleaner, as illustrated in FIG. 8, illustrating the squeegee of FIGS. 11 and 12 as it is installed within an air/debris channel formed within the vacuum cleaner container assembly.

As indicated at 81*a*, 81*b*, a pair of resilient base terminals is mounted substantially flush, in spaced-apart, side-by-side relation at the rear or closed end of base frame 67 a predetermined distance D from the end of fingers 77 for purposes as well appear. Preferably, each of the base terminals 81*a*, 81*b* is formed of a rigid, resilient metal conductor having a terminal base 83 which is in turn fixedly secured to a terminal mounting support 85 integral with base frame 67. A two-conductor charging lead wire 87, constituting power lead PL, extends from the base terminal 81*a*, 81*b* and leads to the AC/DC recharging adapter 4, as illustrated in FIG. 1. Further, each of the base terminals 81*a*, 81*a* has a resilient terminal body 89 cantilevered from terminal base 83, and each of the terminals has a contact camming surface 91 carried on the outer ends of terminal bodies 89. It will be understood with vacuum cleaner 1 from base 3 and with terminals 81*a*, 81*b* in their unflexed positions, the contact camming surfaces 91 thereof are spaced from the end of fingers 77 the above-noted predetermined distance D.

Further in accordance with this invention, vacuum cleaner housing 9 is provided with a pair of spaced housing or appliance terminals 93*a*, 93*b* substantially flush, but somewhat recessed into vacuum cleaner housing 9 which are positioned to cooperate with base terminals 81*a*, 81*b* for the dual purpose of permitting electrical recharging of battery pack 15 and for resiliently holding vacuum cleaner 1 in position on the recharging and holding base 3. More specifically, housing or appliance terminals 93*a*, 93*b* each are mounted on a terminal mounting base 95 integrally molded with vacuum cleaner housing 9, and each of the housing terminals has a resilient terminal body 97 extending from the terminal mounting base. Further, each of the housing terminals has a camming contact surface 99 which is engageable with a respective camming contact surface 91 carried by a respective base terminal 81*a*, 81*b*. It will further be appreciated that the distance between the portion of notch 79 provided in the bottom portion of vacuum cleaner housing 9 and the cam contact faces 99 of vacuum cleaner housing terminals 93*a*, 93*b* is somewhat greater than the distance D between the end of finger 77 and the camming contact surfaces 91 of base terminals 81*a*, 81*b*.

Thus, as shown in FIG. 1, vacuum cleaner 1 of the present invention may be readily removably installed on recharging and holding base 3 by positioning the vacuum cleaner relative to base 3 such that the outwardly extending finger 77 is received within notch 79. Then, the rear portion of vacuum cleaner housing 9 is moved into recess 69 within base frame 67 such that the camming surfaces 99 of housing terminals 93*a*, 93*b* engage the camming contact surfaces 91 of base terminals 81*a*, 81*b*, thus causing both the base terminals and the vacuum cleaner housing terminals to at least somewhat resiliently deflect relative to one another thereby to apply a resilient gripping force between the rear portion of the vacuum cleaner and finger 77 socketed in recess 79. In this manner, recharging of the battery pack 15 proceeds simultaneously with the insertion of the vacuum cleaner onto the recharging and holding base 3, assuming the AC/DC adapter 4 is plugged into a suitable wall electrical outlet in the conventional manner. It will further be appreciated that, in this manner, the battery pack 15 will remain substantially fully charged awaiting use of vacuum cleaner 1.

To remove vacuum cleaner 1 from base 3, the user grasps handle 11 in the manner generally illustrated in FIG. 1, and rotates the rear portion of the handle outwardly away from base 3, thus causing the vacuum cleaner housing terminals 93*a*, 93*b* to resiliently move out of engagement with resilient base terminals 81*a*, 81*b* with the rear portion of the handle clear of the user may then move the vacuum cleaner rearwardly relative to the base such that finger 77 moves clear of notch 79. Thus, the fully charged portable vacuum cleaner is ready for use and it will be noted that it is not necessary to contend with a cord for the vacuum cleaner, and it is further not necessary that the recharging cord be manually unplugged from the vacuum cleaner or reinserted therein when charging of battery pack 15 is desired.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A portable wet/dry hand held vacuum cleaner comprising a housing having a handle permitting a user to lift and operate said vacuum cleaner and a nozzle/debris container releasably secured to said housing, said housing having a motor and a blower driven by said motor which is in communication with said nozzle/debris container for forcibly drawing air and debris including water into the nozzle/debris container, and said nozzle/debris container being constructed to transmit visible light therethrough along a substantial portion of the nozzle/debris container in order that a user may visually observe the amount of debris collected by the vacuum cleaner within the nozzle/debris container.

2. The portable wet/dry hand held vacuum cleaner as defined in claim 1 wherein at least opposite sides of said nozzle/debris container are constructed to transmit visible light therethrough for visibility of the contents of said nozzle/debris container.

3. The portable wet/dry hand held vacuum cleaner as defined in claim 2 wherein the nozzle/debris container is made from a transparent material at least on said opposite sides.

4. The portable wet/dry hand held vacuum cleaner as defined in claim 3 wherein the nozzle/debris container is molded from a transparent plastic resin material.

5. A method of visually observing the contents of a nozzle/debris container in a portable wet/dry hand held vacuum cleaner in order to separate the nozzle/debris container from the vacuum cleaner for emptying the contents of the nozzle/debris container, comprising the steps of:

molding said nozzle/debris container from a transparent plastic resin material in order to transmit visible light therethrough for visibility of the contents of said nozzle/debris container, removably securing said nozzle/debris container to a vacuum cleaner housing having a handle, a motor and a blower driven by said motor to draw air and debris including water into the nozzle/debris container;

operating said vacuum cleaner to draw air and debris into the nozzle/debris container; and visually observing the contents of the nozzle/debris container during operation of the vacuum cleaner to determine when it is appropriate to empty the contents of the nozzle/debris container by separating same from the vacuum cleaner housing.

6. A portable wet/dry hand held vacuum cleaner comprising a housing having a handle permitting a user to lift and operate said vacuum cleaner and a nozzle/debris container releasably secured to said housing, said housing having a motor, a blower driven by said motor and being in communication with said nozzle/debris container for forcibly drawing air and debris including water into the nozzle/debris container, said nozzle/debris container having an inner end secured to said housing and an outer end, said nozzle/debris container further having a bottom for resting on a supporting surface and a top which extends upwardly and rearwardly from said bottom to said housing, a channel extending from the outer end of and within said nozzle/debris container, the outer end of said channel being proximate the container bottom and constituting an air/debris nozzle inlet, said channel being constructed to extend upwardly and rearwardly from the air/debris inlet toward said housing and terminating in an air/debris outlet short of said housing, a filter positioned between the air/debris outlet of said channel and said housing, and deflector means within said nozzle/debris container positioned between the air/debris outlet of said channel and said filter for deflecting air and debris in a direction away from the filter and into the nozzle/debris container.

7. The portable wet/dry hand held vacuum cleaner as defined in claim 6 wherein said channel extends along and conforms to the shape of the top of said nozzle/debris container.

8. The portable wet/dry hand held vacuum cleaner as defined in claim 7 wherein said channel and said container top have a gently curving configuration while extending upwardly and rearwardly from the container bottom.

9. The portable wet/dry hand held vacuum cleaner as defined in claim 6 wherein said deflector means includes curved deflector means positioned to deflect air and debris entrained in the air downwardly into the nozzle/debris container in a rotating or swirling motion to decrease the velocity of the air and debris entrained in the air in order to settle and collect same in the nozzle/debris container.

10. The portable wet/dry hand held vacuum cleaner as defined in claim 9 wherein the curved deflector extends from the top of the nozzle/debris container.

11. The portable wet/dry hand held vacuum cleaner as defined in claim 6 wherein the nozzle/debris container is constructed to transmit visible light therethrough along a substantial portion of the nozzle/debris container in order that a user may readily visually observe the amount of debris collected by the vacuum cleaner within the nozzle/debris container.

12. The portable wet/dry hand held vacuum cleaner as defined in claim 11 wherein the nozzle/debris container is made from a transparent plastic resin material at least on opposite sides thereof.

13. A portable hand held vacuum cleaner and recharging base, said vacuum cleaner having a housing containing rechargeable battery means and a pair of electrical terminals connected to the rechargeable battery means, said pair of electrical terminals also extending to an outer face of said housing, said recharging base having a frame adapted to receive a portion of said housing therein, said frame having a pair of electrical terminals connectable to a source of electrical energy and being positioned for cooperative electrical connection with the pair of housing terminals to permit recharging of the rechargeable battery means, said housing and frame having spaced cooperating resilient interengaging means for applying a resilient interlocking force across a substantial area of said housing and frame in order to releasably interlock said housing and frame together, said housing and frame terminals being proximately located on said housing and frame relative to at least one of said spaced cooperating resilient interengaging means for engagement of said housing and frame terminals to one another when said housing and frame are releasably interlocked together, said housing and frame also including cooperating finger and notch means for alignment of said housing and frame during the releasable interlocking of said housing and frame to one another, said housing and frame terminals constructed to serve as one of said spaced cooperating resilient interengaging means, and said cooperating finger and notch means constructed to serve as the other of said spaced cooperating resilient interengaging means.

14. A portable wet/dry hand held vacuum cleaner comprising a housing having a handle permitting a user to lift and operate said vacuum cleaner and a nozzle/debris container releasably secured to said housing, said housing having a motor and a blower driven by said motor which is in communication with said nozzle/debris container for forcibly drawing air and debris including water into the nozzle/debris container, a debris filter in said vacuum cleaner to filter debris from air drawn into the nozzle/debris container by the motor and blower in said housing, and said nozzle/debris container being constructed to transmit visible light therethrough along a substantial portion of the nozzle/debris container in order that a user may visually observe the amount of debris collected by the vacuum cleaner within the nozzle/debris container.

15. The portable wet/dry hand held vacuum cleaner as defined in claim 14 wherein the debris filter is positioned in said nozzle/debris container adjacent said housing.

16. The portable wet/dry hand held vacuum cleaner as defined in claim 15 wherein the debris filter is located within an air outlet duct that extends from the housing into the nozzle/debris container to provide a flow path between the nozzle/debris container and the blower in said housing, said debris filter being interposed in the air inlet duct immediately ahead of the blower in said housing.

* * * * *

UNITED STATES PATENT AND TRADEMARK OFFICE

CERTIFICATE OF CORRECTION

PATENT NO. : 5,005,252

DATED : April 9, 1991

INVENTOR(S) : Robert E. Steiner, et. al.

It is certified that error appears in the above-identified patent and that said Letters Patent is hereby corrected as shown below:

In the Abstract: line 24 is "such that the vacuum", should be -- such that when the vacuum --;

line 26 is "terminal", should be -- terminals --;

Column 1, line 62 insert a "." after the word "base";

Column 6, line 67 after "enhancing air", insert --entrainment. More specifically, squeege 55 comprises an elongated body portion 57 adapted to be inserted into and to --;

Column 7, line 36 is "test", should be -- best --; and

Column 8, line 3 is "81a", should be -- 81a, 81b --.

Signed and Sealed this

Fifteenth Day of December, 1992

*Attest:*

DOUGLAS B. COMER

*Attesting Officer*

*Acting Commissioner of Patents and Trademarks*